United States Patent [19]

Lamb et al.

[11] Patent Number: 4,708,150

[45] Date of Patent: Nov. 24, 1987

[54] CIGARETTE FILTER

[75] Inventors: Charles G. Lamb; Andrew McMurtrie, both of Louisville, Ky.

[73] Assignee: Brown & Williamson Tobacco Corporation, Louisville, Ky.

[21] Appl. No.: 899,590

[22] Filed: Aug. 25, 1986

[51] Int. Cl.[4] ..... A24D 3/04

[52] U.S. Cl. ..... 131/336

[58] Field of Search ..... 131/336

*Primary Examiner*—V. Millin

*Attorney, Agent, or Firm*—Charles G. Lamb

[57] ABSTRACT

A filter for a cigarette includes a porous filter rod circumscribed by a substantially non-porous or air impermeable wrapper with selected air permeable areas, and ventilating air grooves embedded in the wrapped filter rod which extend from on end of the filter rod a preselected distance generally longitudinally of the filter rod. Tipping material circumscribes the wrapped filter rod and is formed with perforations therethrough providing a path for ventilating air flow into the grooves and into the body of the filter rod at the selected air permeable areas outside of the grooves. The walls of each of the grooves are formed with preselected perforations therethrough to provide for the flow of air from the grooves into the body of the filter rod. Under certain smoking conditions most, if not all, of the ventilating air in the grooves will flow from the grooves into the smoker's mouth through the open end of the grooves at the mouth end of the filter rod. Under certain other smoking conditions, at least a part of the ventilating air flowing in the grooves will pass through the apertures of the groove walls and into the body of the filter rod and air will pass through the air impermeable wrapper into the body of the filter rod outside the grooves. The air flowing into the filter body co-mingles with and dilutes the smoke flowing through the filter.

4 Claims, 3 Drawing Figures

CIGARETTE FILTER

BACKGROUND OF THE INVENTION

1. Field of the Invention

This invention relates to a filter for cigarettes. In one aspect it relates to a filter with novel ventilating air means. In another respect the invention relates to a filter for a cigarette having flow directing grooves formed therein for directing ventilation air to the mouth end of the filter under certain smoking conditions, delivering air diluted filtered smoke through the filter to the mouth end of the filter and under other certain smoking conditions, for directing at least some ventilating air passes from the flow directing grooves and into the filter to co-mingle with and further dilute the smoke flowing in the filter before it reaches the mouth end of the filter.

2. Description of the Prior Art

It is well known in the art to add filters to cigarettes wherein the filters are provided with ventilation air means to bring ambient air into the filter to dilute the smoke passing therethrough. The dilution of the smoke reduces the quantity of smoke particulates as well as the gas phase components which are delivered to the smoker's mouth. A number of means have been proposed and are utilized for introducing ventilating air into the cigarette. For example, the wrapper for the tobacco of a cigarette can be made from a porous material which allows for introduction of air along the entire length of the cigarette where it mixes with the smoke stream passing therethrough thereby diluting the smoke in the stream. Also the cigarette wrapper may be perforated at selected locations along the length of the cigarette which provides ports in the cigarette through which ventilating air enters. Even further, it is known to perforate the wrapper of the filter of a filtered cigarette to allow ventilating air to enter the filter and dilute the smoke stream passing through the filter. There have also been a number of suggestions for incorporating grooves within the filter of a filter cigarette to facilitate the addition of ventilating air into the smoke stream.

For example, U.S. Pat. No. 3,596,663 relates to a tobacco smoke filter provided with a corrugated porous plug wrap surrounding a filter element which is circumscribed by tipping paper having flow-through perforations. The ventilating air enters into the filter element and the grooves through the perforations in the tipping paper and progresses to the smoker's mouth. And, U.S. Pat. No. 4,256,122 teaches a filter for a cigarette which includes grooves extending longitudinally along the outer surface of a filter rod circumscribed by a non-porous plug wrap and the rod and wrap are enclosed with ventilating tipping paper so that in use only ventilating air travels down the grooves and only smoke travels through the filter. Other patents which related to cigarette filters having grooves circumscribing the filter element for the introduction of ventilating air into the cigarette filter include U.S. Pat. No. 3,577,995; U.S. Pat. No. 3,752,347; U.S. Pat. No. 3,490,461; U.S. Pat. No. 3,788,330; U.S. Pat. No. 3,773,053; U.S. Pat. No. 3,752,165; U.S. Pat. No. 3,638,661; U.S. Pat. No. 3,608,561; U.S. Pat. No. 3,910,288; and U.S. Pat. No. 4,256,122.

SUMMARY OF THE INVENTION

The present invention advantageously provides a straightfoward arrangement of a filter for a cigarette which achieves essentially normal cigarette pressure drop with low to moderate efficiency filters. The present invention further provides a cigarette filter for lowering tar predominantly by ventilation while also providing filtration of air diluted cigarette smoke. The present invention, in addition, provides a grooved cigarette filter with air flow outlets at the mouth end wherein under certain conditions air-flow means into the the filter are provided in the walls of the grooves and at selected areas of the peripheral surface of the filter outside the grooves.

More particularly, the present invention provides for a filter for a cigarette comprising:

a porous filter rod of generally cylindrical configuration;

an air impermeable wrapper extending longitudinally along said filter rod from one end thereof to the other end and circumscribing said rod leaving flow-through opposed ends of said filter rod;

said wrapper being formed with a plurality of grooves embedded into said filter rod, each of said grooves being open at one end of said filter rod and extending therefrom in a generally longitudinal direction of said filter rod for a distance less than the length of said filter rod;

tipping material extending longitudinally of and circumscribing the wrapped filter rod;

first flow-through perforations formed through the tipping material, said first perforations being open to and in communication with said grooves providing for air flow into said grooves, said first perforations being sized for air flow therethrough and into the grooves at a first preselected pressure drop;

second air flow perforations formed through the tipping material and wrapper in a preselected area outside said grooves providing for air flow into the body of said porous filter rod, said second perforations being sized for air flow therethrough at a second preselected pressure drop greater than said first preselected pressure drop; and, third air flow perforations formed through the wrapper in each of said grooves providing for air flow from the grooves into the body of said porous filter rod, said third perforations being sized for air flow therethrough at a third preselected pressure drop greater than said second preselected pressure drop.

BRIEF DESCRIPTION OF THE DRAWINGS

A better understanding of the invention will be had with reference to the following description in conjunction with the accompanying drawings in which like numerals refer to like parts throughout the several views and wherein.

DESCRIPTION OF THE PREFERRED EMBODIMENT

Figure 1:
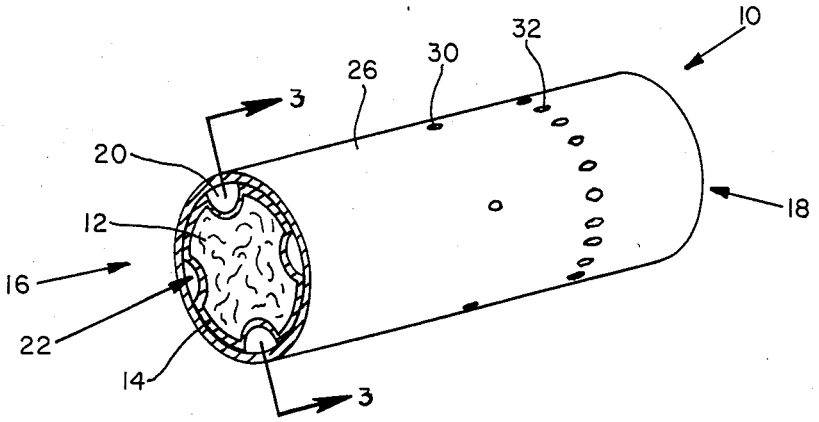
FIG. 1 is a perspective view of one advantageous embodiment of a cigarette filter of the present invention.
Figure 2:
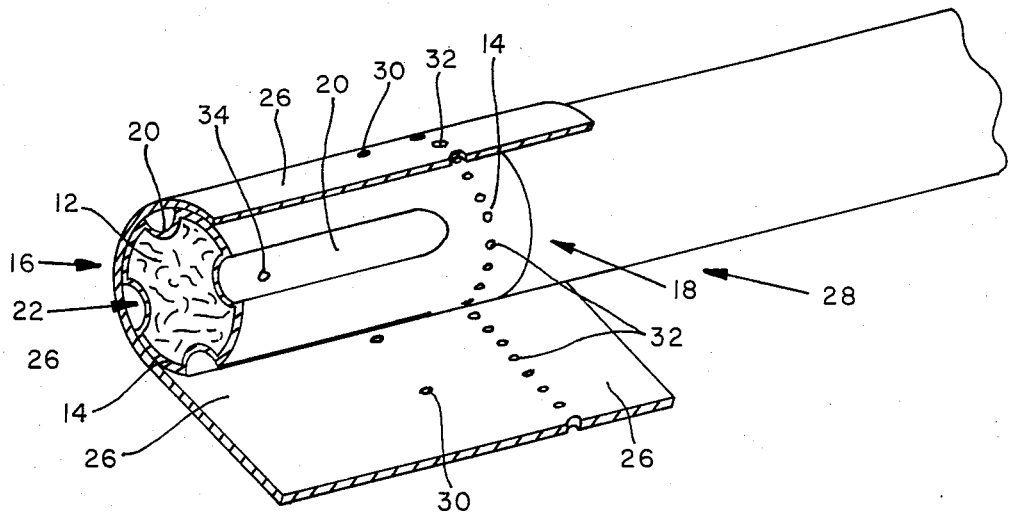
FIG. 2 is a perspective view of the filter of FIG. 1 attached to a tobacco rod but showing the tipping material partially unwound to more clearly show details; and, FIG. 3 is a cross-sectional view of the filter as seen in the direction of arrows 3—3 in FIG. 1.
Figure 3:
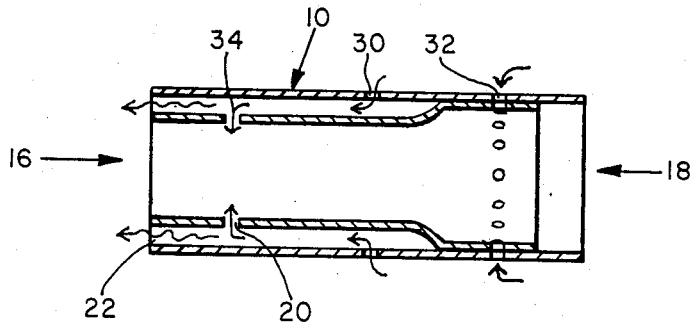

FIGS. 1, 2 and 3 illustrate a cigarette filter, generally denoted as the numeral 10, incorporating the features of the present invention. The cigarette filter 10 is shown as comprising a generally cylindrically shaped filter rod 12 and an air impermeable circumscribing wrapper 14. The wrapper 14 extends longitudinally along the filter rod 12 from one end 16 of the filter rod to the other end 18 thereof so that the filter rod ends 16 and 18 are in mutual flow through relationship.

The filter rod 12 is fabricated of a porous material such as, for example, fibrous or foamed cellulose acetate, or any other material suitable for filtering cigarette smoke.

The cigarette filter 10 further comprises a plurality of grooves 20 formed in the wrapper 14 and embedded into the filter rod 12. Each of the grooves 20 is open as designated by the numeral 22 at the mouth end 16 of the filter rod 12, and extends therefrom in a generally longitudinal direction of the filter rod 12 for a distance less than the length of the filter rod. FIGS. 1, 2 and 3 illustrate four such grooves 20 equally spaced from each other about the circumference of the filter rod 12.

In the manufacture of the cigarette 10, the wrapper 14 can be integrally formed with the filter rod 12 or be a separate component. The wrapped filter rod 12, for example, can be placed in a mold or other treating means for depressing the wrpper 14 at selected locations thereby embedding the wrapper 14 into the filter rod 12 and forming the grooves 20. One such method is commonly referred to in the cigarette manufacturing industry as a heat molding technique.

As can best be seen in FIG. 2, the filter rod 12 is attached to a tobacco column 24 with tipping material 26 which circumscribes the wrapper covered filter rod 12 to form a filtered cigarette 28. First air flow-through means such as first air flow perforations 30 are formed through the tipping material 26 in a first circumferential array around the circumference of the filter rod 12. The first air flow perforations 30 are located closer to the closed ends of the grooves 20 than to the open ends of the grooves 20. Preferably, the first perforations 30 are located just downstream of the closed ends of the grooves 20, i.e., that end of each groove opposite its open 22 at the mouth end 16 of the filter rod 12. Preferably, the first small flow-through ventilating air perforations 30 are open to and communicate with the grooves 20 near the closed end of the grooves providing for the flow of air into the grooves 20. The first air flow-through perforations are sized for air flow therethrough at a first preselected pressure drop.

The wrapper 14 is formed with second air flow-means such as second air flow perforation 32 through the tipping material 26 and wrapper 14 in a first preselected area outside of the grooves providing for air flow therethrough into the body of the porous filter rod 12. The second air flow perforations 32 are illustrated as being in a circumferential array around the circumference of the filter rod 12 upstream of the closed ends of the grooves 20. The second perforations 32 are sized for air flow therethrough at a second preselected pressure drop greater than the first preselected pressure drop.

The wrapper 14 has third air permeable flow means in a preselected area in the grooves 20 such as small air flow-through perforations 34 formed through the thickness of the wrapper 14 in each of the groves 20 providing for air flow from the grooves into the body of the porous filter rod 12. The third perforations 34 are located closer to the open ends of the grooves 20 than to the closed ends of the grooves 20. Preferably, the third perforations 34 are located near the open end 22 of the grooves 20. The third perforations 34 are sized for air flow therethrough at a third preselected pressure drop greater than the second preselected pressure drop.

For conventionally sized cigarette filters, which typically have a diameter of approximately 8 mm, it has been determined that a first perforation 30 having a diameter of about $\frac{1}{2}$ mm, a second perforation 32 having a diameter of $\frac{1}{2}$ mm and a third perforation 34 having a diameter of $\frac{3}{8}$ mm works well to provide the necessary differential pressure drop values between the first, second and third perforations 30, 32, and 34, respectively. It has further been determined that first perforations 30 located between approximately 2 mm to approximately 4 mm from the closed end of the grooves 20, and the third perforations 34 located between approximately 2 mm to approximately 4 mm from the open end 22 of the groove 20 is advantageous.

In operation, as best shown in FIG. 3, under certain smoking conditions wherein the grooves 20 are unobstructed, a majority of the ventilating air will flow through the first perforations 30 and into the grooves 20, along the grooves 20 and into the smoker's mouth from the open ends 22 of the grooves 20. Very little, if any, ventilation air will flow through the second perforations 32 and third perforations 34 because the pressure drop across these perforations 32 and 34 is substantially greater than the pressure drop through the first perforations 30 and along the grooves 20 to the open ends 22 of the grooves 20. As the grooves 20 may become obstructed, for example, at the open ends 22 of the grooves 20 creating an increasing pressure drop along the grooves 20, then increasing amounts of ventilation air will enter the body of the filter rod 12 through the second perforations 32 and also will pass from the grooves 20 through the perforations 34 into the body of the filter rod 12.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

What is claimed is:

1. A filter for a cigarette comprising:

a porous filter rod of generally cylindrical configuration;

an air impermeable wrapper extending longitudinally along said filter rod from one end thereof to the other end and circumscribing said rod leaving flow-through opposed end of said filter rod;

said wrapper being formed with a plurality of grooves embedded into said filter rod, each of said grooves being open at the mouth end of said filter rod and extending therefrom in a generally longitudinal direction of said filter rod for a distance less than the length of said filter rod;

tipping material extending longitudinally of and circumscribing the wrapped filter rod;

first flow-through perforations formed through the tipping material, said first perforations being open to and in communication with said grooves providing for air flow into said grooves, said first perforations being sized for air flow therethrough and into the grooves at a first preselected pressure drop;

second air flow perforations formed through the tipping material and wrapper in a preselected area outside said grooves providing for air flow into the body of said porous filter rod, said second perforations being sized for air flow therethrough at a second preselected pressure drop greater than said first preselected pressure drop; and, third air flow perforations formed through the wrapper in each of said grooves providing for air flow from the grooves into the body of said porous filter rod, said third perforations being sized for air flow therethrough at a third preselected pressure drop greater than said second preselected pressure drop.

2. The filter of claim 1, wherein said first flow through perforations are located closer to the closed ends of the grooves than to the open ends of the grooves.

3. The filter of claim 1, wherein said third flow through perforations are located closer to the open ends of the grooves than to the closed ends of the grooves.

4. The filter of claim 1, wherein the second flow through perforations are located upstream of the closed ends of the grooves.

* * * * *